US006402068B1

(12) United States Patent
Handleman

(10) Patent No.: US 6,402,068 B1
(45) Date of Patent: Jun. 11, 2002

(54) EDUCTOR MIXER SYSTEM

(76) Inventor: Avrom R. Handleman, 324 Hawthorne, Webster Groves, MO (US) 63119

( * ) Notice: Subject to any disclaimer, the term of this patent is extended or adjusted under 35 U.S.C. 154(b) by 0 days.

(21) Appl. No.: 09/472,462

(22) Filed: Dec. 27, 1999

Related U.S. Application Data

(63) Continuation-in-part of application No. 09/129,924, filed on Aug. 6, 1998.

(51) Int. Cl.[7] ..... B02C 23/26
(52) U.S. Cl. ..... 241/39; 241/5
(58) Field of Search ..... 241/5, 9, 39

(56) References Cited

U.S. PATENT DOCUMENTS

| | | | |
|---|---|---|---|
| 992,144 | A | 5/1911 | Babcock |
| 1,116,971 | A | 11/1914 | Barker |
| 1,458,523 | A | 6/1923 | Coutant |
| 1,724,625 | A | 8/1929 | Sweeny |
| 1,806,287 | A | 5/1931 | Forrest |
| 1,901,797 | A | 3/1933 | Black |
| 2,100,185 | A | 11/1937 | Engstrand |
| 2,310,265 | A | 2/1943 | Sweeny |
| 2,695,265 | A | 11/1954 | Degnen |
| 2,722,372 | A | 11/1955 | Edwards |
| 3,152,839 | A | 10/1964 | Edwards |
| 3,166,020 | A | 1/1965 | Cook |
| 3,175,515 | A | 3/1965 | Cheely |
| 3,186,769 | A | 6/1965 | Howlett, Jr. |
| 3,276,821 | A | 10/1966 | Edwards |
| 3,368,849 | A | 2/1968 | Cheely |
| 3,614,000 | A | 10/1971 | Blythe |
| 3,720,482 | A | 3/1973 | Tell |
| 3,777,775 | A | 12/1973 | Handleman |
| 3,876,156 | A | 4/1975 | Muschelknautz et al. |
| 4,007,694 | A | 2/1977 | Fowler et al. |
| 4,055,870 | A | 11/1977 | Furutsutsumi |
| 4,172,499 | A | 10/1979 | Richardson et al. |
| 4,186,772 | A | 2/1980 | Handleman |
| 5,522,555 | A | 6/1996 | Poole |
| 5,577,670 | A | 11/1996 | Omata et al. |

FOREIGN PATENT DOCUMENTS

| | | |
|---|---|---|
| CA | 780113 | 3/1968 |
| DE | 0224776 | 7/1985 |
| SU | 1733098 | 5/1992 |

*Primary Examiner*—Allen Ostrager
*Assistant Examiner*—William Hong
(74) *Attorney, Agent, or Firm*—Polster, Lieder, Woodruff & Lucchesi, L.C.

(57) ABSTRACT

An improved eductor-mixer system in which pressurized working fluid is discharged through a cylindrical annular nozzle as a translational high speed jet flowing longitudinally past a end of a solute inlet tube into a tubular discharge passage having a uniform inner diameter greater than the outer diameter of the annular nozzle, for generating a vacuum thereby to positively draw a pressure transportable material such as a granular, powdered, or other particulate solid, or a liquid or a gas, through the solute inlet tube and into the tubular discharge passage for mixing with the working fluid to form a dispersion.

10 Claims, 5 Drawing Sheets

EDUCTOR MIXER SYSTEM

CROSS-REFERENCE TO RELATED APPLICATIONS

Continuation-in-part of U.S. Application Ser. No. 09/129,924, filed Aug. 6, 1998.

STATEMENT REGARDING FEDERALLY SPONSORED RESEARCH OR DEVELOPMENT

Not Applicable.

BACKGROUND OF THE INVENTION

This invention relates to an eductor-mixer system particularly adapted for the preparation of dispersions, solutions and slurries. More particularly, the eductor-mixer system of this invention is an improvement over the eductor-mixer system disclosed in my prior U.S. Pat. Nos. 4,186, 772 and 3,777,775.

An eductor-mixer system is designed to continuously mix a solute such as paint pigments, fire retardants, liquids and gels, (e.g., a powder, particulate, or other pressure transportable or fluidizable material, a liquid or a gas) and a solvent or working fluid (e.g., a liquid or in some instances a gas) to form a dispersion, slurry, or solution.

The solute inlet of an eductor-mixer system is conventionally connected to the discharge outlet of a fluidized container so that a vacuum generated within the eductor-mixer by the flow of solvent (working fluid) through an internal nozzle cooperates with the fluidized discharge of the powder from the container to positively draw the fluidized solute into the eductor-mixer. Existing state-of-the-art eductor-mixer systems typically include a conical, converging stream of working fluid, as most solutes used with these systems require a relatively large diameter solute tube and conveying line (more than 1.0–1.5 inches) to be transported vacuum pneumatically without clumping or clogging. With such large diameter delivery tubes, a conical nozzle is required to deflect the working fluid stream into a discharge tube small enough in diameter to meet the cross-sectional area criterion for vacuum generation and mixing. Although some solute materials may be vacuum transported in smaller diameter tubes, these smaller diameter solute tubes suffer from accretion of the solute material at the discharge outlet due to small amounts of the working fluid splashing back into the solute tube from turbulence formed at the conical deflector in the discharge tube.

Additionally, traditional eductor-mixer systems are thought to be somewhat burdened by the introduction of an radial component of translational energy into the conical converging jet of working fluid, and hence are not as efficient as theoretically possible in generating the vacuum to positively draws the solute thereinto. Reference may be made to U.S. Pat. Nos. 1,806,287, 2,100,185, 2,310,265, 2,695,265, 2,772,372, 3,166,020, 3,186,769, and to Canadian Pat. No. 790,113, each of which discloses various eductor-mixer systems and air conveying apparatus in the same general field as the present invention.

In many known prior art eductor-mixer systems, the powder supply, even if it is in a fluidized container, is required to be located above the level of the eductor-mixer system because the latter is dependent upon gravity feed of the powder. In the systems shown in the U.S. Pat. Nos. 4,186,772 and 3,777,775, the eductor-mixers are not dependent upon gravity feed because the vacuum within the eductor-mixer is sufficient to positively draw the powder from the container into the eductor-mixer systems, and thus these systems are not dependent upon the relative location of the powder container and the eductor-mixer system.

The eductor-mixer system of the present invention is a significant improvement of the aforementioned eductor-mixer systems and is capable of conveying a greater amount of material and generating a higher vacuum pressure due to an improved nozzle design. Furthermore, it overcomes problems associated with splash-back and clogging of narrow diameter solute tubes commonly associated with the use of conical working fluid jets.

BRIEF SUMMARY OF THE INVENTION

Among the several objects and features of this invention may be noted the provision of an eductor-mixer system particularly well suited for either continuous or batch preparation of dispersions, solutions, or slurries from a fine granular, particulate, or powdered solute, or other pressure transportable or fluidizable material and a working fluid or solvent;

The provision of such an eductor-mixer system which is also capable of mixing gas or vapor solutes with liquid or gaseous working fluids; the provision of such an eductor-mixer system which thoroughly mixes the solute and working fluid;

The provision of such an eductor-mixer system which is self-flushing and which effectively prevents back flow of the working fluid into the solute inlet;

The provision of such an eductor-mixer system which minimizes working fluid flow losses therethrough and which is highly efficient in transferring momentum from the working fluid to the solute and to the resulting dispersion;

The provision of such an eductor-mixer system which minimizes the introduction of a radial component of translational energy to the working fluid stream, maximizing the kinetic energy available to produce a vacuum capable of drawing the solute through the solute tube;

The provision of such an eductor-mixer system which eliminates the need for convergence of the working fluid stream, directing substantially all of the working fluid kinetic energy in a longitudinal manner;

The provision of such an eductor-mixer system which is optimized for use with smaller diameter solute delivery tubes;

The provision of such an eductor-mixer system which substantially eliminates splash-back of the working fluid into the solute delivery tube due to turbulence;

The provision of such an eductor-mixer system in which relatively high vacuum levels may be efficiently generated therewithin so as to positively draw fluidizable material into the eductor-mixer system and so that the relative location of the eductor-mixer system and the fluidizable material supply is much less critical;

The provision of such an eductor-mixer system which reduces undesired turbulence adjacent the location of the fluidizable material supply;

The provision of such an eductor-mixer system in which the radial location of the eductor nozzle is dependent upon the outer diameter of the solute tube, and the cross sectional area of the nozzle is proportional to the cross sectional area of the discharge tube;

The provision of such an eductor-mixer system in which certain parts subject to flow erosion may be readily and inexpensively replaced and may be adjusted relative to one another to compensate for wear so as to lengthen the service life while maintaining the desired flow characteristics through the eductor-mixer;

The provision of such an eductor-mixer system in which certain parts thereof may be readily changed so as to vary the flow rate through the eductor-mixer system within a predetermined range; and The provision of such an eductor-mixer system which is of relatively simple and rugged construction, which is reliable in operation, which may be retrofitted to existing eductor-mixer systems, and which requires no special training or skill for use.

In general, an eductor-mixer system of this invention comprises an eductor body having a working fluid passage extending therethrough for flow of a pressurized working fluid from one end of the working fluid passage, constituting an inlet end, to the other end of the working fluid passage, constituting a discharge end, the working fluid passage being generally of uniform circular cross-section throughout its length. The body has an opening therein opposite the discharge end of the working fluid passage with the opening being coaxial with the discharge end and being of substantially smaller diameter than the diameter of the working fluid passage. A insert comprising a ring separate from the body, having inside and outside faces, and a central opening therethrough from its inside to its outside face, is removably mounted in place at the discharge end of the working fluid passage coaxial with the discharge end. The central opening in the ring being of substantially smaller diameter than the diameter of the working fluid passage. A cylindrical tube of substantially smaller diameter than the diameter of the working fluid passage extends from outside the body through the opening in the body opposite the discharge end of the working fluid passage and extends forward in the working fluid passage from the inner end of the opening in the body into the central opening in the ring. The tube is open at its end in the central opening in the ring, the open end of the tube constituting a discharge end. The tube is axially adjustable in, and removable from, the opening, and is adapted for connection of its end outside the body to a source of fluent material to be educted and mixed with the working fluid for the flow of the material through the tube and out of the discharge end of the tube. The discharge end of the tube is substantially coplanar with the outside face of the ring. The inner periphery of the ring bounding the central opening in the ring is formed in-part as a entrance extending from the inside face towards the outside face of the ring and convergent in downstream direction from the inside to the outside face of the ring, and in part as a cylindrical nozzle surface extending from the narrowest portion of the entrance to the outside face of the ring. The narrowest portion of the entrance of the ring surrounds and is spaced from the cylindrical exterior surface of the tube a distance which is small relative to the diameter of the outer end of the entrance, the cylindrical nozzle surface thereby providing an annular orifice between the exterior cylindrical surface of the tube and the cylindrical nozzle surface of the ring for delivery of the pressurized working fluid from the passage through the orifice. The pressurized working fluid is delivered in the form of an annular jet. The gap between the exterior cylindrical surface of the tube and the cylindrical nozzle surface of the ring is relatively small and the length of the annular cylindrical orifice is relatively short for rapid acceleration of the working fluid flowing through the orifice to a relatively high linear velocity with low flow losses. Means separate from the ring providing a discharge passage downstream from the ring at the discharge end of the working fluid passage in the body in which the material issuing from the discharge end of the tube and the working fluid cylindrically jetted through the orifice may mix, is removably secured to the body at the discharge end of the working fluid passage in the body. The discharge passage extends outwardly from the ring and has an external diameter at its end at the outside face of the ring larger than the diameter of the cylindrical nozzle surface of the ring, the internal surface of the means lying outward of, and parallel to, the projection of the jet throughout its length.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several Figures of the drawings.

DESCRIPTION OF THE PREFERRED EMBODIMENT

Figure 1:
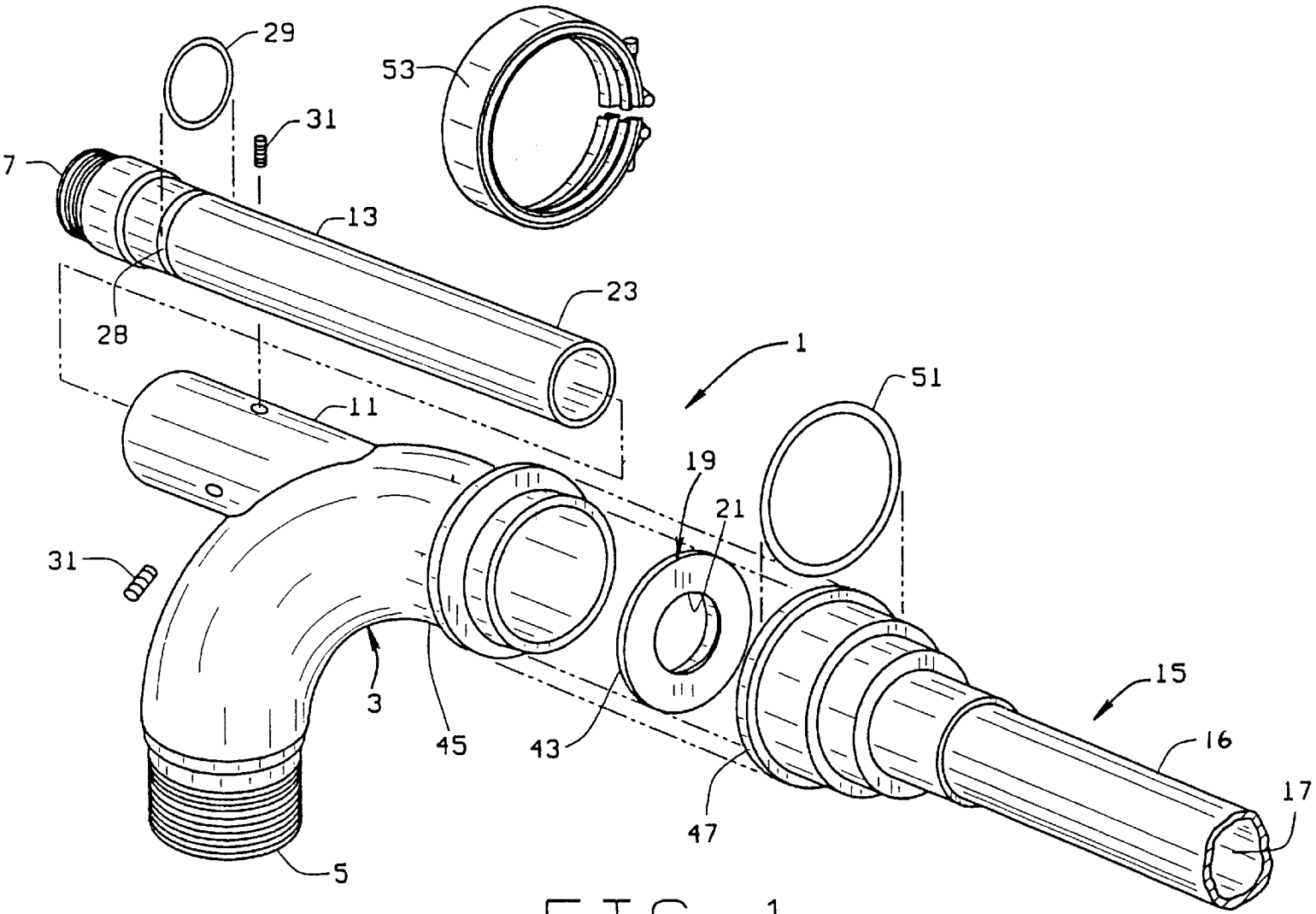
FIG. 1 is an exploded perspective view of an eductor-mixer of this invention.

The following detailed description illustrates the invention by way of example and not by way of limitation. The description will clearly enable one skilled in the art to make and use the invention, describes several embodiments, adaptations, variations, alternatives, and uses of the invention, including what we presently believe is the best mode of carrying out the invention.

Referring now to the drawings, a preferred embodiment of the eductor-mixer of the present invention, indicated in its entirety at 1, is shown to comprise an eductor body or housing 3, having a curved passage therethrough for a working fluid or solvent from an inlet 5 at one end of the passage (also referred to as a first inlet). The housing is adapted to be connected to a source of pressurized working fluid or solvent (e.g., to a liquid line or a pump) and to convey the working fluid or solvent to the other end of the passage, constituting a discharge end, and a second inlet 7 adapted to be connected to a supply of pressure transportable or fluidizable material (also referred to herein as a solute or fluent material). The passage is generally of uniform circular cross-section throughout its length. However, passages having non-uniform cross sectional areas and of different shapes such as "T" forms, may be adapted for use with the disclosed eductor-mixer system, and correspondingly are considered within the scope of the invention. As mentioned above, the solvent inlet may be connected to the discharge side of a liquid pump or to another source of pressurized working fluid. Inlet 7 may be connected via an appropriate hose to the discharge opening of a fluidized container.

Fluidized containers are used in transporting and storing "semi-bulk" quantities (e.g., more than a bag full and less than a truck or railroad car full) of powdered, fine granular, particulate, or other fluent or fluidizable material, such as powdered fire retardant materials, paint pigments, cement, oil well drilling muds, barite, diatomaceous earth, talc, lime, etc. It is often necessary to mix the powdered solute with a solvent upon unloading of the solute to form a dispersion, slurry or solution. While the eductor-mixer system of this invention described and claimed hereinafter will be referred to primarily in conjunction with fluidized containers for mixing powdered solutes with liquid solvents, it will be understood that the eductor mixer system of this invention need not be used in conjunction with a fluidized container, and it may be used to mix all types of solutes and solvents. It will be particularly understood that the eductor-mixer system of this invention may be used to mix both liquid and gaseous solvents and solutes.

Figure 2A:
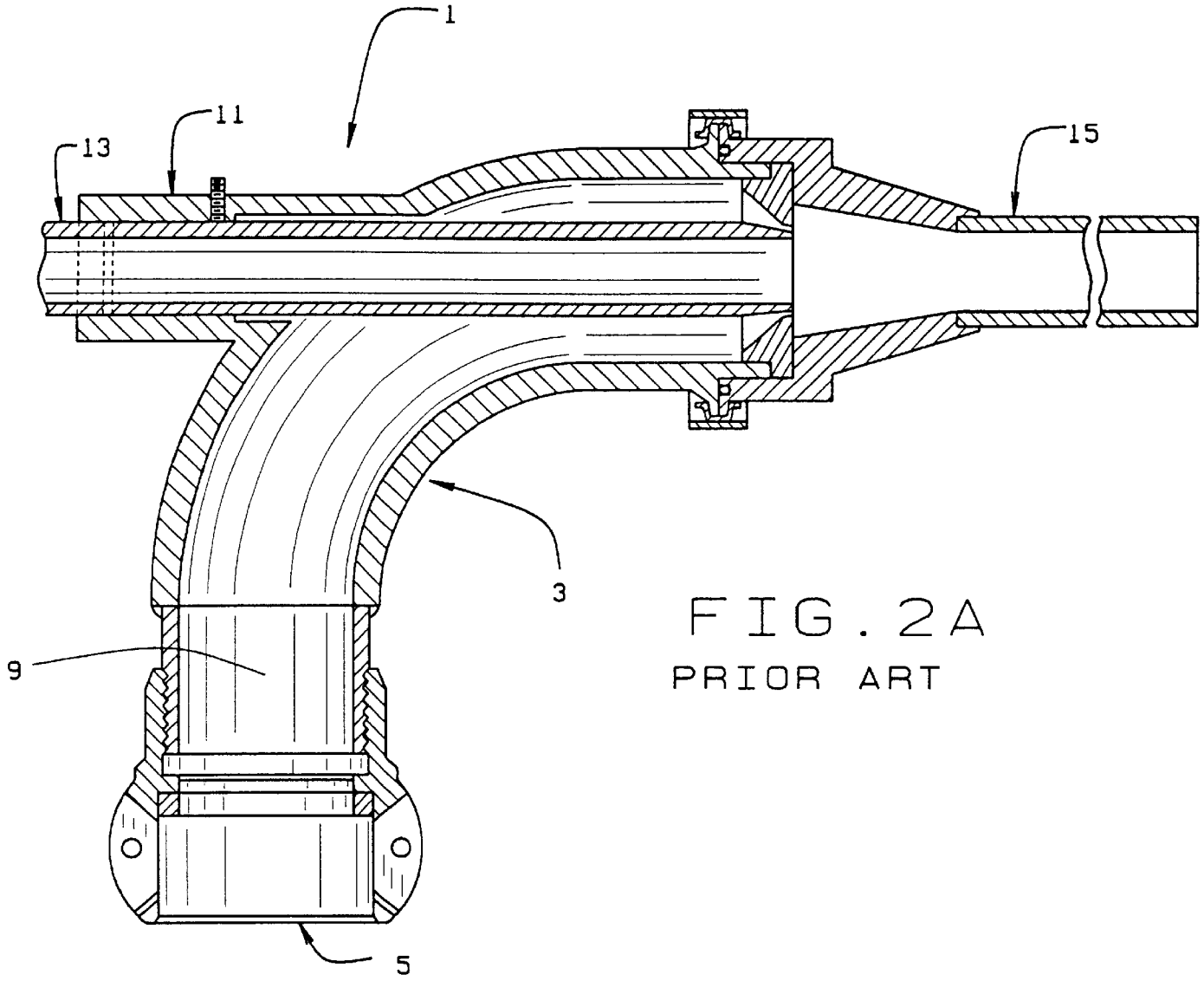
FIG. 2A PRIOR ART
FIG. 2A is a longitudinal cross-sectional view of a prior art eductor-mixer.
Figure 2B:
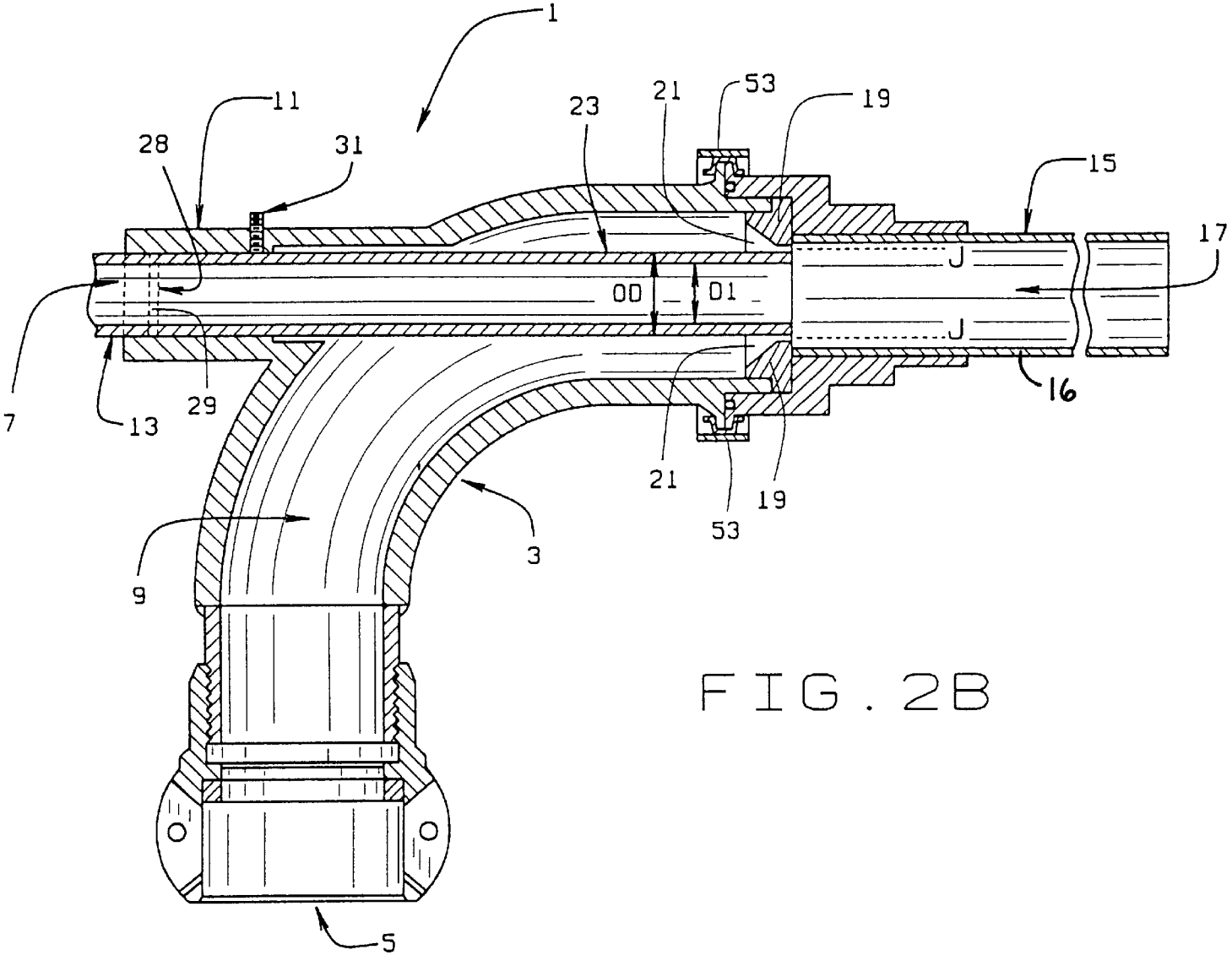
FIG. 2B is a longitudinal cross-sectional view of the eductor-mixer of the present invention.

The eductor-mixer system of the present invention is an improvement over the eductor-mixer system shown in U.S. Pat. Nos. 4,186,772 and 3,777,775, illustrated in FIG. 2A. Referring now to FIGS. 1 and 2B, the body or housing 3 of the eductor-mixer system of this invention is preferably cast or fabricated of a suitable metal, such as stainless steel, and has the passage or plenum chamber 9 formed therewithin in communication with solvent inlet 5. A sleeve 11 extends from the housing coaxial with the discharge end of the passage. It will be understood, however, that sleeve 11 could extend internally into housing 3. While housing 3 is shown to be generally in the shape of a 90° pipe elbow, it will be understood that the housing may assume other shapes and still be in the scope of the invention. Solute inlet 7 is shown to comprise a cylindrical tube 13 of somewhat smaller diameter than the bore of sleeve 11. Tube 13 is insertable into the sleeve so as to extend through plenum chamber or passage 9 with the pressurized working fluid or solvent filling the plenum chamber or passage and surrounding the solute inlet tube. A receiving member, generally indicated at 15, is removably secured to housing 3. The interior of this receiving member constitutes a passage means 17 in which the solute is dispersed in the solvent and in which the solute and solvent are mixed. An insert 19 is disposed within housing 3 at the discharge end of the passage or chamber 9 between chamber 9 and passage means 17. This insert is shown to be a flat ring having a central or nozzle opening 21 therein which receives the inner or discharge end of solute tube 13. The nozzle opening 21 is somewhat larger than the outer diameter of the discharge end of the solute tube and the latter is substantially centered within the opening 21 thereby to define an annular nozzle opening or orifice N concentric with the solute tube through which working fluid under pressure in plenum chamber or passage 9 is discharged at high velocity into the receiving member 15. The solvent is discharged as an annular jet J, and it generates a vacuum within the passage means. The vacuum is in communication with the discharge end of solute tube 13 and thus positively draws or sucks the solute into the passage means 17.

Figure 3:
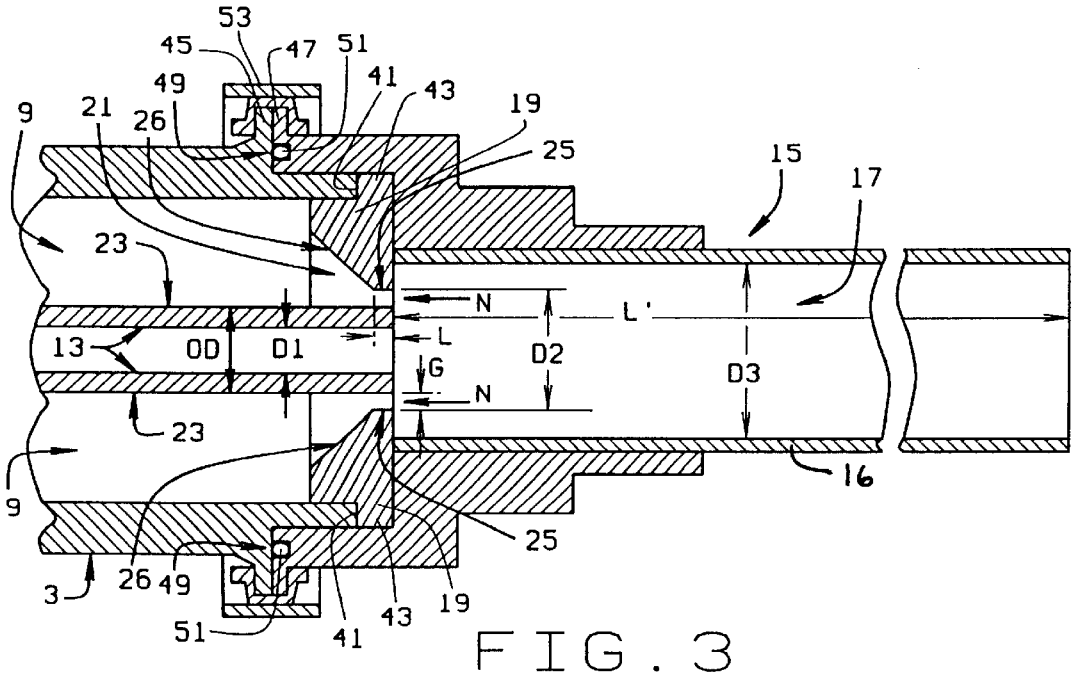
FIG. 3 is an enlarged cross-sectional view of a portion of the eductor-mixer illustrating certain details of the eductor nozzle.

As best shown in FIG. 3, solute tube 13 is of substantially smaller diameter than passage 9 and has uniform outer diameter OD and inner diameter D1 adjacent the discharge end, thereby having a cylindrical exterior surface 23. Insert 19 has an inner cylindrical nozzle surface 25 concentric to the cylindrical exterior surface 23, which defines a central opening or nozzle 21. The insert 19, at its inside face (toward the left in FIGS. 2B and 3), has a conical entrance 26 converging toward the cylindrical nozzle surface 25. The latter extends from the narrowest portion of the conical entrance 26 to the outside face (toward the right in FIGS. 2B and 3) of the ring. The diameter of opening 21 and the length of cylindrical nozzle surface 25 in the direction of flow through the nozzle depend on the desired flow conditions through the nozzle. It will be appreciated that the flow rate through the nozzle is similarly a function of the pressure within plenum chamber or passage 9 and passage means 17 and the cross sectional flow area of nozzle N. The latter is the cross-sectional area of the gap G (see FIG. 3) between cylindrical exterior surface 23 of the solute tube and the cylindrical nozzle surface 25. The vacuum generated by the jet discharged from the nozzle into the passage means is dependent upon the velocity of the jet.

The eductor-mixer 1 of this invention is particularly well suited to efficiently accelerate the working fluid from plenum chamber or passage 9 into the passage means 17 in several important ways. First, the cross-sectional area of the plenum chamber or passage is quite large in relation to the cross-sectional area of nozzle N. This allows working fluid to flow through the passage at a speed much slower than it flows through the nozzle so that there is little or no energy lost by the flow of the working fluid through the passage. The length L of the nozzle in the direction of the flow therethrough is relatively quite short. This permits the solvent to be almost instantaneously accelerated to its discharge velocity in a short distance, thus minimizing the flow losses while flowing through, and discharging from, the nozzle at high linear velocity. At one extreme, nozzle surface 25 may be a sharp knife edge having an extremely short effective length L (e.g., a few thousandths of an inch) in the direction of flow through the nozzle. In other instances, the nozzle surface may preferably have longer length L approximately equal in length to the width of gap G for purposes that will later be described. It will be understood that as the nozzle length L increases, shear (and related energy loss) in the nozzle is increased. Shear, of course, is also greater with narrower nozzle gaps.

Second, it has also been found that the ratio of the nozzle length L to the gap thickness G (i.e., L/G) preferably should range between about 0.001 for a knife edge surface 23 and up to about 10 for a cylindrical nozzle surface 25 which is parallel to the exterior cylindrical surface 23 on tube 13. As shown in FIGS. 2B and 3, receiving member 15 comprises a constant-diameter discharge conduit 16 abutting the outside surface of the nozzle member 19, defining passage means 17. The diameter D3 of the inner end or bore of the discharge conduit 16 is slightly larger than the outer diameter D2 of nozzle opening 21.

A third way in which the eductor-mixer system of this invention minimizes energy loses is to equalize the areas into which the jet of fluid passing through nozzle N can expand. To provide equal areas of expansion, the cross sectional area of the discharge conduit 16, as seen in FIG. 3, which is inside the jet at the surface of the annular nozzle N, having the diameter OD of the solute tube 13, must be equal to the cross sectional area of the discharge conduit 16 which is external to the jet at the surface of the annular nozzle N. This second cross sectional area is defined as the annular area between the inner diameter D3 of the discharge conduit and the outer diameter of the annular nozzle N, defined by D2 at the outer surface of the nozzle N. When these two cross sectional areas are of equal size, the jet of fluid passing through nozzle N can expand in a uniform manner in all directions without encountering any obstructions, thereby minimizing energy loss.

A fourth way in which the eductor-mixer system of this invention minimizes energy losses is that the internal surface of discharge conduit 16 adjacent nozzle N lies outward of and parallel to the projected path of the cylindrical jet J (as indicated by the dotted lines in FIG. 3) as the jet is discharged from the nozzle. This insures that frictional wall losses along the passage means walls are minimized as the jet flows at high speeds into the passage means. Further, the diameter of the discharge conduit at any point there along is larger than the diameter of the projected path of the jet so as to insure that the walls of the discharge conduit are clear of the jet. In accordance with this invention, the cross-sectional area of the discharge conduit 16 downstream from passage means 17 is about 3 to 10 times the cross-sectional area of gap G.

Figure 4:
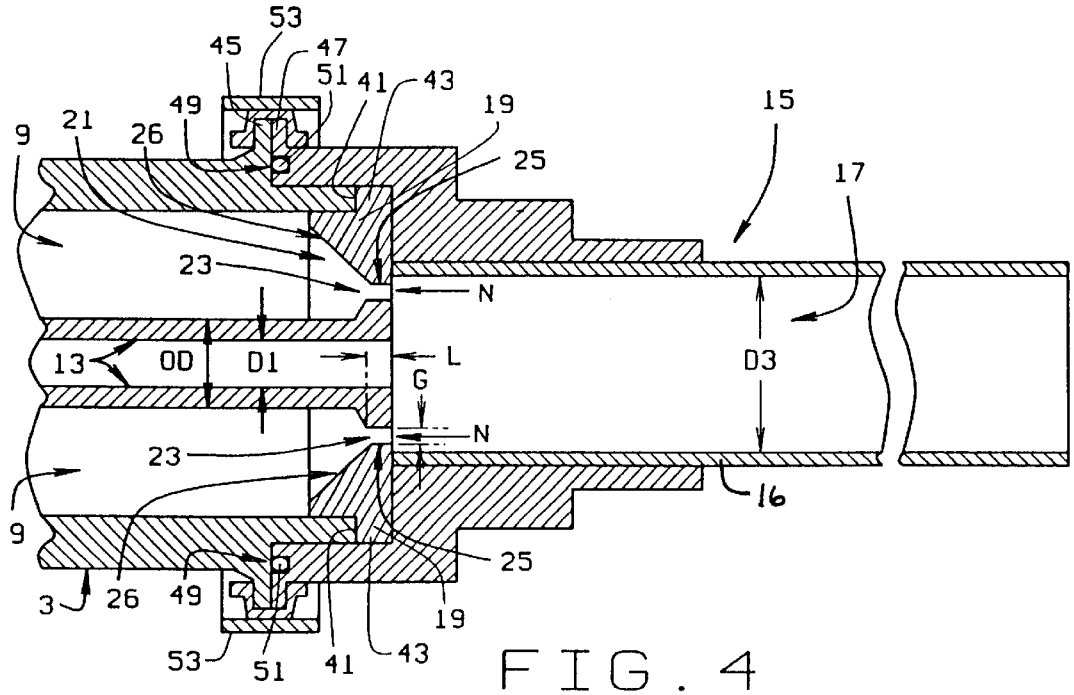
FIG. 4 is an enlarged cross-sectional view of a portion of the eductor-mixer illustrating enlarged solute tube wall thickness.

Finally, by discharging the solvent in a concentric cylindrical jet J, as opposed to a converging conical jet as described in the referenced patents, the radial component of the jet's energy is substantially eliminated, and the translational kinetic energy available to produce the vacuum is correspondingly increased. Eliminating the converging jet further results in backsplash of the solvent towards the discharge end of the solute tube 13 being substantially eliminated, preventing accretion of the solute and clogging of the tube. Displacement of the jet away from the opening in the discharge end of the solute tube 13 may be further accomplished by a uniform increase in the wall thickness of the solute tube as shown in FIG. 4, adjacent the discharge end, and a corresponding radial enlargement of the cylindrical nozzle surface 25 outward to maintain the cross sectional area of gap G within the desired range. Once skilled in the art will recognize that the resulting structure will have an annular nozzle of a larger diameter, a gap G of narrower width, and no corresponding change in cross sectional area of the gap.

Figure 5:
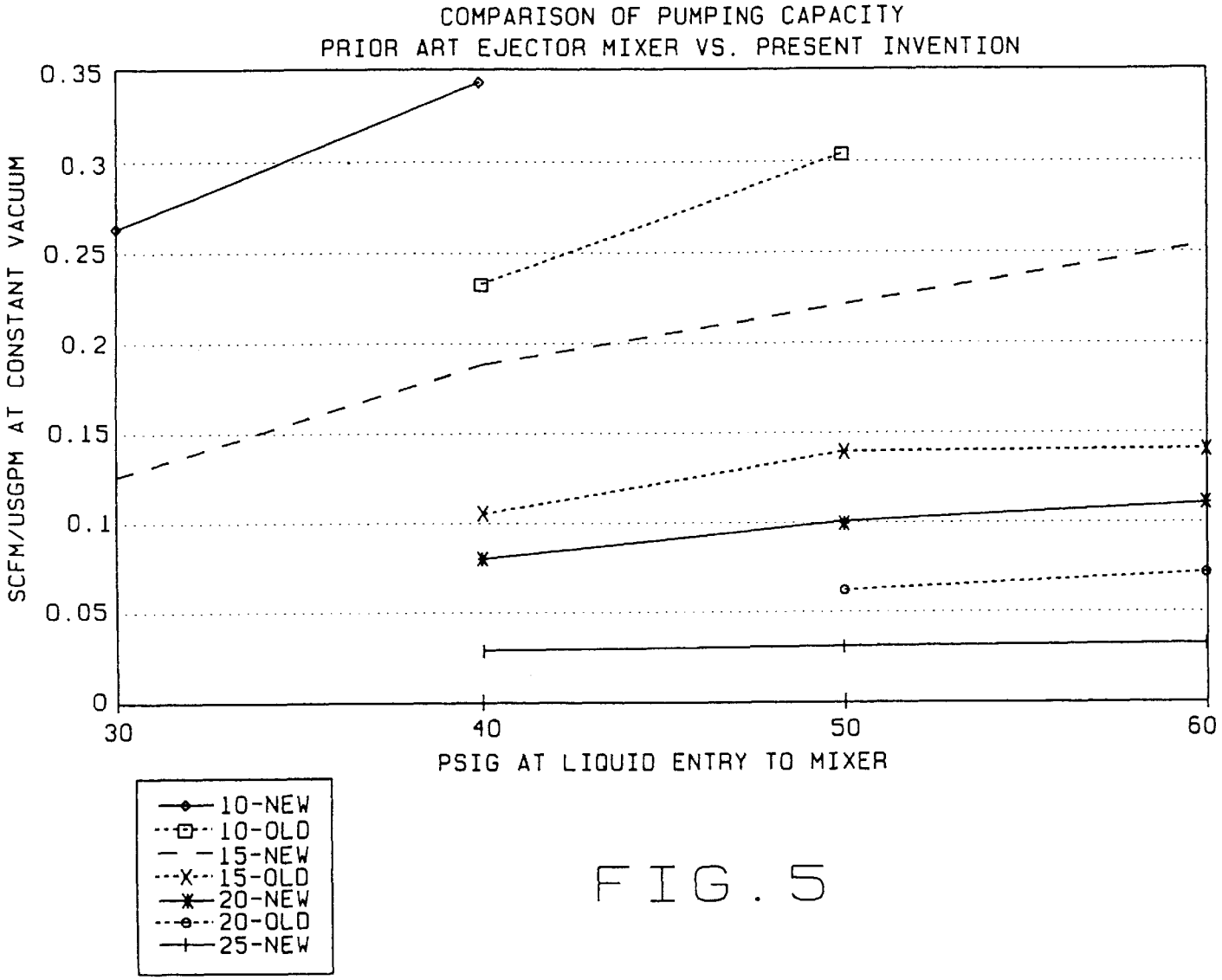
FIG. 5 is a chart comparing the vacuum pumping capacity of an eductor-mixer system of the present invention with that of the prior art, illustrating the improved efficiency of the present invention.

These improvements result in a dramatic increase in the efficiency of the eductor-mixer system over the systems described in the referenced patents, as can be seen from reference to FIG. 5, which compares the vacuum pumping capacity of the eductor-mixer system disclosed in U.S. Pat. No. 4,186,772 with that of the present invention. In FIG. 5, at a predetermined working fluid pressure, both the volume of gas drawn through the solute tube and the flow rate of the liquid exiting the discharge conduit were measured to produce a ratio representative of the vacuum pumping capacity. For example, with a working fluid pressure of 40 psig measured at the first inlet, the prior eductor-mixer system yields a vacuum pumping capacity ratio of 0.23 scfm/usgpm, whereas the present invention at the same fluid pressure yields a vacuum pumping capacity ratio of 0.34 scfm/usgpm, a 48% improvement in efficiency.

It will be understood that in operation, the jet J of working fluid eventually collapses on the stream of fluidizable material discharged from inlet tube 13 into passage means 17, thereby initiating mixing of the working fluid and the material. The working fluid and the material move at high velocity through the passage means thus maintaining a relatively high vacuum. As the working fluid and material enter conduit 26, mixing is even further enhanced and mixing continues substantially along the length of the conduit.

As described above, the vacuum generated by the educator-mixer system 1 of this invention is more efficient than the prior art eductor-mixer system shown in the above U.S. Pat. Nos. 4,186,772 and 3,777,775 in positively drawing the solute into the eductor-mixer system. Thus, the eductor-mixer system of this invention is able to be displaced from the level of the powdered solute in the solute fluidized container a greater distance than had been heretofore possible thereby making the location of the eductor-mixer system and the solute supply even less critical.

It will be understood that the surfaces 23 and 25 on the solute tube and insert, respectively, may be hardened (e.g., carburized or nitrided) to provide a hard wear-resistant surface for resisting flow wear abrasion by the solvent and solute flowing therethrough at high speeds. It will also be understood that, alternatively, these surfaces may be hardened by making them of a special material which resists flow wear abrasion.

As heretofore described, solute tube 13 extends into housing 3 through sleeve 11 with the sleeve having an inside diameter slightly greater than the outside diameter of the solute tube. The latter has one or more circumferential grooves 28 for receiving an O-ring seal 29 which in turn seals the solute tube relative to the bore of the sleeve when the former is axially inserted into the latter. This seal permits the solute tube to be moved axially in and out of the sleeve while remaining sealed relative thereto. As is best shown in FIG. 2B, the sleeve 11 is substantially coaxial with nozzle opening 21 in insert 19 and with mixing tube 15. Preferably, solute tube 13 is inserted into housing 3 via sleeve 11 and through plenum 9 so that the discharge end of the tube is generally coplanar with the downstream end of nozzle surface 25 and is coaxial with nozzle opening 21 so that the gap G is of uniform thickness around the tube and so that the solvent in the plenum surrounds the solute tube. A plurality (e.g., three) of threaded fasteners 31 is threadably carried by sleeve 11 for engagement with the outer surface of solute tube 13. With all of the fasteners 31 engaging the outer surface of tube 13, the tube is firmly secured in place relative to the sleeve at any desired axial position within the sleeve. By adjusting the various fasteners 31 in and out, the end of the tube may be readily adjusted relative to nozzle surface 25, and secured in position when the tube is properly centered within the nozzle opening with gap G being of substantially uniform thickness around the outlet end of the solute tube. It will also be noted that in the event the cylindrical exterior surface 23 of the solute tube becomes worn so as to affect the flow geometry through the eductor-mixer, fasteners 31 may be loosened and solute tube 13 may be readily removed thereby to enable resurfacing of cylindrical exterior surface 23 on the tube, or the solute tube may be moved farther into the housing thereby to accommodate the wear of the solute tube and/or the wear of nozzle surface 25. With fasteners 31 located in sleeve 11 clear of the insert 19 and plenum 9, solvent flows through the plenum and the nozzle opening without encountering any resistance from the fasteners. It will also be noted that in its preferred embodiment, the nozzle opening or orifice through the eductor-mixer of the present invention is a continuous annular gap around the solute tube with no supports, flow dividers or other restrictions in the nozzle which would block or otherwise impede the flow of fluid therethrough. In this manner, the concentric solvent jet is a continuous annular jet as it is discharged from the nozzle. It will be understood, however, that flow dividers could be placed between the outer surface of the solute tube and the inner surface of the nozzle for supporting or centering the outer end of the solute tube in the nozzle opening. If this is done, the solvent jet discharged from the nozzle will not necessarily be a continuous annular jet, but rather would be a series of separate cylindrical jets within the passage means. These separate jets are considered to be within the scope of the present invention.

As heretofore mentioned, insert 19 is a ring-like member and, as best shown in FIG. 3, has a shoulder 41 in its front face toward chamber 9 and an outwardly projecting flange 43. Shoulder 41 has a diameter substantially the same as the circular inner bore of housing 3 and thus the step is readily received within the open end of the housing so as to center the nozzle opening relative to the longitudinal center line of sleeve 11 and solute tube 13 inserted therein. Housing 3 and receiving tube 15 each have respective flanges 45 and 47 adapted to be sealingly secured together in face-to-face relation. With the receiving tube flange 47 in sealing engagement with nozzle flange 43, insert 19 is held captive in a desired position relative to the housing and the receiving member. A circumferential groove 49 is provided on the outer face of flange 47 for receiving an O-ring 51 which seals the receiving member to the housing. Flanges 45 and 47 each have sloped outer faces and are adapted to be drawn together by a sealing hoop clamp 53, such as is commercially available from the Aeroquip Company of Los Angeles, Calif. Upon tightening clamp 53 on flanges 45 and 47, these flanges are drawn into face-to-face sealing engagement with the O-ring 51. It will be understood, however, that means other than clamp 53 may be used for releasably and sealably securing the mixing tube 15 to housing 3. It will thus be appreciated that eductor 1 of this invention may readily be converted from one flow rate capacity to another merely by exchanging one insert 19 for another having different nozzle opening dimensions and exchanging receiving member 15 to maintain a desired ratio between the gap cross sectional area and the passage means cross sectional area.

In accordance with this invention, the length L' of the conduit 16 is preferably about 5 to 50 times longer than its diameter D3, and even more preferably, is about 15 to 30 times longer than its diameter so as to enhance the mixing (i.e., dispersion) of the solute and the working fluid within the conduit. Expressed in another manner, the ratio L'/D3 preferably should range between about 5 and 50 and even more preferably between about 15 and 30. It will be understood, however, that this ratio could be varied considerably and even be outside the abovestated preferred ranges and still be within the scope of this invention. This ratio depends upon many factors, such as the physical characteristics of the solute and solvent being mixed, the flow rates and pressures, and temperatures of the solute and solvent, and many other factors. Thus, this ratio could vary considerably and satisfactory mixing of the solute and solvent could still be attained within the eductor-mixer system of this invention. The above-stated preferred ranges indicate ranges which for many materials have been readily and satisfactorily mixed by the apparatus of this invention.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. In an eductor-mixer system consisting of an eductor body with a passage extending therethrough for the flow of a pressurized working liquid from one end of the passage, constituting an inlet end, to the other end of the passage, constituting a discharge end;

an annular insert within said passage and adjacent the discharge end;

a solute tube of smaller diameter than the diameter of said passage, said solute tube extending from outside said eductor body into said eductor body with the inner end of said solute tube being substantially coaxial with respect to said annular insert and with the inner end of said solute tube terminating substantially coplanar with the downstream face of said annular insert;

a discharge tube connected to said body downstream from said insert; and said solute tube and said annular insert opening defining an annular nozzle, said pressurized liquid, upon flowing through said annular nozzle undergoing a substantial increase in velocity so as to generate an area of low pressure within said discharge tube downstream from said annular nozzle, said solute tube being adapted for the conveying of a flowable material which can be a granular, powdered, or other particulate solid, or a liquid or a gas, therethrough for mixing with said pressurized working liquid downstream from said annular nozzle;

wherein the improvement comprises of:

said solute tube in the region of said annular nozzle having a uniform cylindrical outer surface defining an inner surface of said annular nozzle; and said inner surface of said annular insert defining an outer surface of said annular nozzle, said annular nozzle inner and outer surfaces defining a conical upstream entrance converging to a uniform cylindrical passage opening coaxial with said solute tube, so as to maximize the longitudinal velocity component of the working liquid as it emerges from said annular nozzle into the discharge tube.

2. The eductor-mixer system as set forth in claim 1 wherein the improvement further comprises a first cross-sectional area defined by a diameter of said outer surface of said solute tube, a second cross-sectional area of an annular region bound by said inner diameter of said discharge tube and a diameter of said outer surface of said annular nozzle, said first cross-sectional area equal to said second cross-sectional area.

3. The eductor-mixer system as set forth in claim 1 wherein the length of said annular nozzle is about 0.10–2.0 times the distance between said solute tube and said insert in the region defining said annular nozzle.

4. The eductor-mixer system as set forth in claim 1 wherein said discharge tube has an inner cross sectional area 2–10 times the cross sectional area of said annular nozzle opening.

5. In the eductor-mixer system as set forth in claim 1 wherein the length of said discharge tube is about 15–30 times the inner diameter of said discharge tube.

6. The eductor-mixer system as set forth in claim 1 wherein said annular nozzle is configured such that the velocity of said working liquid emerging from said annular nozzle ranges between about 30 feet/second and 300 feet/second.

7. In an eductor-mixer system having an eductor body including a working liquid passage extending therethrough for flow of a pressurized working liquid from one end of the passage, constituting an inlet end, to the other end of the working liquid passage, constituting a discharge end, and said eductor body having a tube receiving opening therein opposite said discharge end, said tube receiving opening being coaxial with said discharge end and of substantially smaller diameter than said working liquid passage;

an annular nozzle member comprising a ring separate from the eductor body and having front and rear faces, a central opening therethrough from its front to its rear face, said ring being removably mounted in place at the discharge end of said working liquid passage, coaxial with said discharge end, said central opening being of substantially smaller diameter than the diameter of said working liquid passage;

a cylindrical tube of substantially smaller cross-sectional area than said working liquid passage extending from outside said eductor body through said tube receiving opening in said eductor body opposite the discharge end of the working liquid passage and extending forward in said working liquid passage from the inner end of said opening in the body into the central opening in the ring, said tube being open at a first end in said central opening in said ring, said open first end constituting a discharge outlet;

said tube being adapted for connection a second end outside the body to a source of fluent material to be educted for flow of said material through said tube and out of said discharge outlet;

the discharge outlet being substantially coplanar with the outside face of the ring;

a discharge passage provided downstream from said ring at the discharge end of the working liquid passage in said body in which the material issuing from the discharge end of the tube and the working liquid may mix;

wherein the improvement comprises of:

said tube having a cylindrically uniform exterior surface adjacent said discharge outlet;

said inner periphery of said ring bounding the central opening forming a conical entrance converging to a cylindrical nozzle surface extending from the downstream edge of said conical entrance to said outside face of the ring, said conical entrance and said cylindrical nozzle surface coaxial with said exterior cylindrical surface of said tube;

said cylindrical nozzle surface of the ring surrounding and being spaced from said cylindrical exterior surface of said tube a distance which is small relative to the diameter of the outer end of the cylindrical nozzle surface, thereby defining an annular nozzle between the cylindrical exterior surface of the tube and the cylindrical nozzle surface for delivery of the pressurized working liquid from said working liquid passage through said nozzle in the form of a hollow jet directed in the downstream direction from the outside face of the ring;

an area defining said annular nozzle between the cylindrical exterior surface of the tube and the cylindrical nozzle surface of the ring being relatively small and the length of said annular nozzle being relatively short for rapid acceleration of the working liquid flowing through the annular nozzle to a relatively high linear velocity;

said discharge passage being removably secured to said body at the discharge end of the working liquid passage in the body, extending outwardly from said ring and having a uniform internal diameter at a first end abutting the outside face of said ring larger than the outer diameter of said cylindrical nozzle, the internal surface of said discharge passage lying outward of and wholly clear of the projection of said hollow jet throughout the length of said hollow jet.

8. The eductor-mixer system as set forth in claim 7 wherein:

said ring includes a peripheral flange engaging the end of said body at the discharge end of said working liquid passage;

said discharge passage comprises a discharge conduit having a length of uniform diameter, said discharge conduit abutting and retaining said ring in the discharge end of said working liquid passage; and means removably securing said discharge conduit to said body.

9. The eductor-mixer system as set forth in claim 7 wherein the cross sectional area of said discharge passage is proportional to the cross sectional area of said annular nozzle, and the radial location of said annular nozzle is dependent upon the outer diameter of the cylindrical exterior surface of said solute tube.

10. The eductor-mixer system as set forth in claim 7 wherein a first cross-sectional area of said discharge passage contained within said annular nozzle is equal to a second cross-sectional area of said discharge passage surrounding said annular nozzle.

* * * * *